US005678335A

United States Patent [19]

Gomi et al.

[11] Patent Number: 5,678,335

[45] Date of Patent: Oct. 21, 1997

[54] DISPLAY DEVICE AND DISPLAY ELEMENT UNIT

[75] Inventors: Masato Gomi; Noriaki Ito; Yasuo Nakamura, all of Shizuoka, Japan

[73] Assignee: Koito Manufacturing Co., Ltd., Tokyo, Japan

[21] Appl. No.: 413,700

[22] Filed: Mar. 30, 1995

[30] Foreign Application Priority Data

Apr. 13, 1994 [JP] Japan ..... 6-097877

[51] Int. Cl.[6] ..... G09F 21/04

[52] U.S. Cl. ..... 40/550; 362/800; 362/812

[58] Field of Search ..... 40/550; 362/311, 362/235, 249, 800, 812, 252, 250

[56] References Cited

U.S. PATENT DOCUMENTS 3,145,493 8/1964 Escalante ..... 362/252 X 5,097,612 3/1992 Williams ..... 40/550 X 5,126,929 6/1992 Cheselske ..... 362/800 X

*Primary Examiner*—Kenneth J. Dorner

*Assistant Examiner*—Cassandra Davis

*Attorney, Agent, or Firm*—Koda and Androlia

[57] ABSTRACT

A display groove is formed along a display pattern provided on a display panel, and a display element unit is arranged along the display groove as a light source to constitute a display device. The display element unit 2 has one or more LED's inserted into a unit case 21 having an elongated opening so that light is emitted over the width area and the length area of this lens 25 for providing an emitted state of a wide display pattern along a display groove in a small number of LED's 231 along the display pattern.

1 Claim, 11 Drawing Sheets

DISPLAY DEVICE AND DISPLAY ELEMENT UNIT

BACKGROUND OF THE INVENTION

1. Field of the Invention

The present invention relates to a display device using a light emitting diode (LED) which constitutes a display element unit so that a desired pattern is displayed by using a plurality of such display element units.

2. Related Art

For the conventional display device, for example, a traffic sign, there has been proposed a device in which an electric bulb is used as a light emitting source for enhancing visibility thereof at night. A display pattern to be displayed is formed of light-transmitting material. At the same time, an electric bulb is arranged behind the pattern so that a display pattern is displayed by illuminating the display pattern with the light of the electric bulbs. However, the conventional display device suffers from a problem in that it requires a commercial power source or battery because the consumed power is large for lighting the electric bulbs so that the facilities of power source become complicated and enlarged. Further, there also arises another problem that the maintenance of the replacing the electric bulbs becomes troublesome because the life of the electric bulb is short.

In view of the afore-mentioned problems, recently another type of display device is proposed which utilizes a light emitting diode (LED) as a light source. In the display device using the LED, a plurality of LED's are arranged as a point light source in a plane-like configuration along a display pattern and are lit to serve as a surface light source which collects the point light sources with the result that a display pattern having a predetermined area is displayed. In such a case, LED's are used which have either a hybrid structure in which LED element chips are arranged on a circuit substrate or a discrete structure in which each of the LED elements are individually resin sealed. In the case of the discrete structure, there is also proposed a structure in which a plurality of discrete LED's are formed into one unit as disclosed, for example, in Unexamined Japanese Utility Model Applications Nos. Sho. 64-34682, Hei. 2-29081, and Hei. 2-38700. Thus such display device has an advantage in that the consumed power is reduced and the life can be extended compared with an electric bulb by employing the LED as a light source with the result that the display device can be free of the maintenance.

Thus, a display having a structure in which LED's are arranged along a display pattern, the structure is more advantageous than the electric bulb. However, when the area of the display pattern is enlarged to constitute a large-size display, LED's needs to be arranged over the entire area of the display pattern because the light emitting area is small at the lighting of the LED. Consequently, a large number of LED's are required. As a consequence, a problem arises in that a larger number of LED's are required than electric bulbs so that the cost of the display as a whole becomes higher. Further, another problem also arises in that such an increase in the number of the LED's reduces the effect of the reduction in the consumed power so that the reduction in the running cost is limited. In such a case, a space between adjacent LED's are inevitably enlarged when an attempt is made to reduce the number of LED's. Thus the amount of light at the intermediate portions of the LED is reduced to provide a display having a non-uniform brightness thereby deteriorating an ostensible visibility of the display pattern.

On the other hand, it sometimes happens that the display pattern is changed as a display content. For example, in the case of a sign for displaying the site of road construction, the display pattern needs to be changed along with the change in the construction site. In such a case, it is not economically effective to change the whole display because various kinds of displays must be prepared in a large number corresponding to various forms of construction. Therefore, in the aforementioned display device employing the LED's, voluntary display patterns are displayed by selectively emitting the LED's after the LED's are arranged on a plane in matrix configuration or in a pattern configuration common among display patterns that are to be changed (for example, see Unexamined Japanese Utility Model Application No. Hei. 1-71807). However, in such a case, individual LED's serves as a point light source. Consequently, there arises a problem in that an extremely large number of LED's are needed in the case where the display is enlarged to provide a display pattern. Thus this leads to the aforementioned disadvantage.

SUMMARY OF THE INVENTION

An object of the present invention is to provide a display device which enables displaying a desired display pattern having a large display area by using the smallest possible number of LED's.

Further, another object of the present invention is to provide a display device which enables changing the display pattern without increasing the number of LED's which are required at the time of the change of the display pattern.

Further, still another object of the present invention is to provide a display element unit which is used in the display device as a light source having an area of a predetermined size by using a small number of LED's.

The above and other objects can be achieved by a provision of a display device which, according to the present invention, a plurality of light sources are arranged along a display pattern for the display by emitting these light sources, the display device comprises: each of said light sources having a light emitting diode (LED) in a unit case which is formed in an elongated open configuration; and wherein the display device is constituted as a display element unit having a lens which disperses at least in a lengthwise direction of the unit case.

For example, the display device of the present invention is constituted in such a manner that a linear display groove opens along a display pattern provided on a display panel, and a plurality of display element units are arranged along this display groove to be attached on the display panel.

Further, it is also possible to form a display pattern on a panel assembly provided separately from the display pattern of the display and to detachably provide the panel assembly on the display panel.

On the other hand, the display element unit according to the present invention comprises a rectangular cylinder part formed in a rectangular cylindrical configuration with an elongated opening and a support flange provided on one end portion of the rectangular cylinder part, one or more LED's mounted on a printed circuit board incorporated and supported in the unit case, and lens for dispersing in a lengthwise and widthwise direction of the unit case the light emitted by the LED's.

For example, two LED's are arranged in series along a lengthwise direction of the unit case, and the lens comprises a light expanding part for expanding light from each of the LED's in a lengthwise direction and a dispersing part for dispersing light emitting from the light expanding part both in a lengthwise and a widthwise direction.

Further, it is preferable to form in a narrow width one side of a support flange provided on the unit case whereas forming the other side thereof in a tapered wide width.

A display pattern having a large area compared with the number of LED's can be displayed by arranging a plurality of display element units that can emit light in a relatively large area with a small number of LED's. Then a cost for producing the display device can be reduced and the consumed power can also be reduced.

Further, the display pattern can be changed with respect to the display by providing a display pattern on a panel assembly separately from the display. Then various display pattern can be changed.

Further, the display element unit can realize a display device which enables illumination of a large area by dispersing light emitting from the LED's both in the lengthwise direction and in the widthwise direction by using one LED. Consequently, a display can be realized which can display a relatively large display area with a small number of LED's.

DESCRIPTION OF THE PREFERRED EMBODIMENTS

Next, preferred embodiments according to the present invention will now be described with reference to the accompanying drawings.

Figure 1:
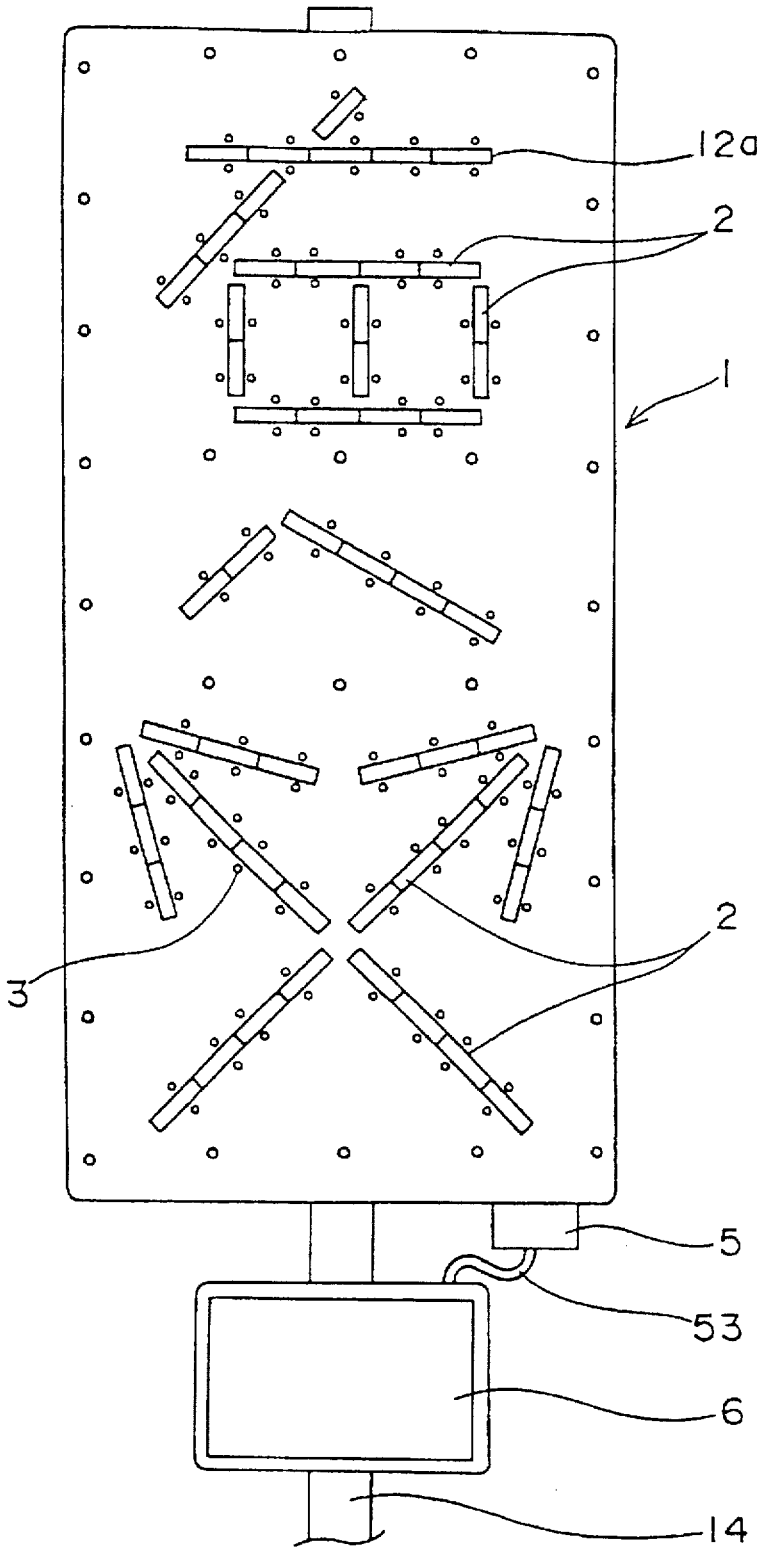
FIG. 1 is a front view of a first embodiment in which the present invention is applied to a road sign.
Figure 2:
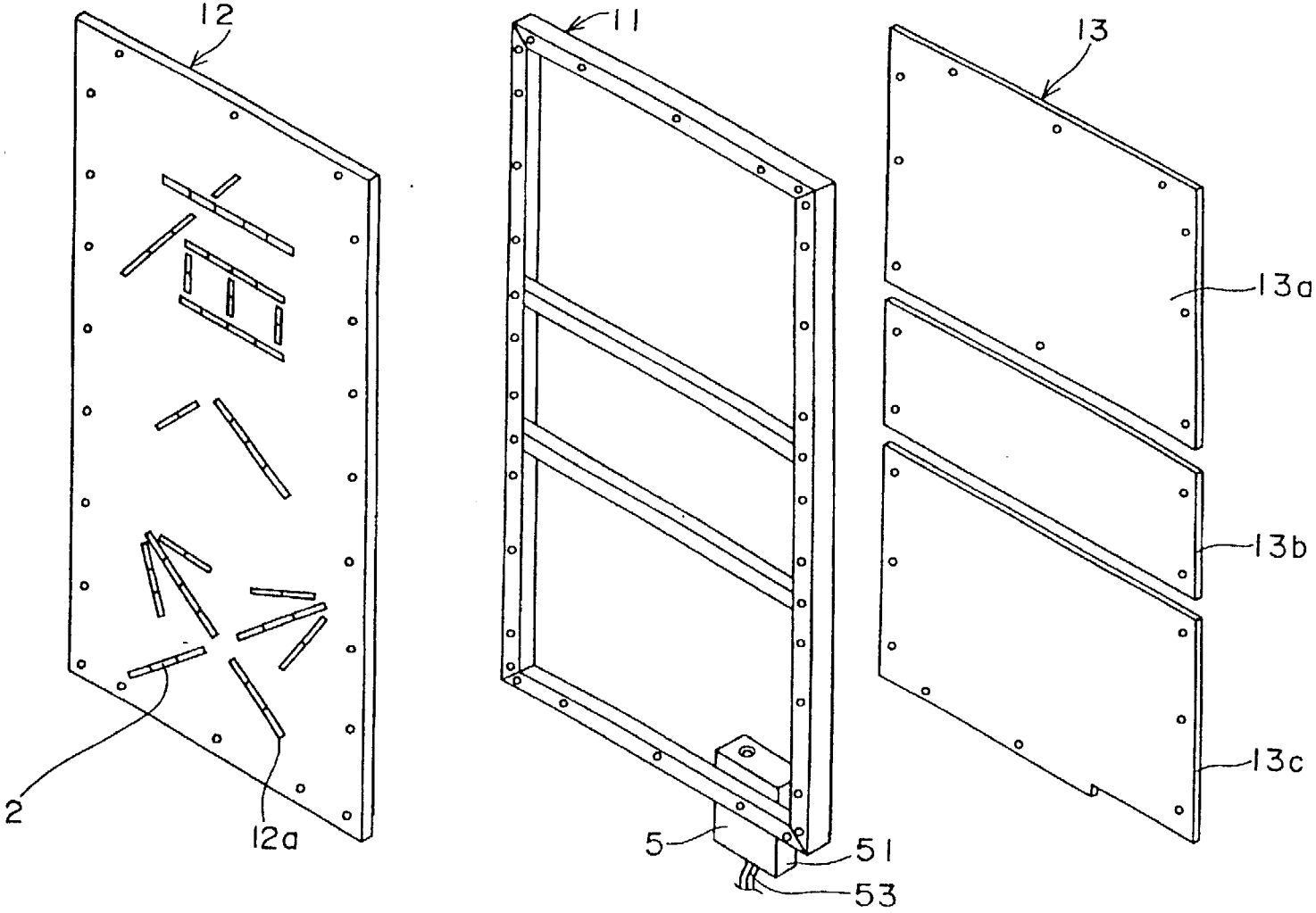
FIG. 2 is a partially exploded perspective view showing a concept construction of FIG. 1.

FIG. 1 is a front view showing a first embodiment in which the present invention is applied to a road construction sign, the view showing a sign device for guiding running vehicles either to the right car lane or to the left car lane depending on the situation of road construction. FIG. 2 is a schematic perspective view showing an exploded essential portion of the sign device. Referring to FIGS. 1 and 2, the sign device 1 has a vertically long rectangular frame body 11. On the front surface side of the frame body 11, a display panel is bolted. On the other hand, on the rear surface thereof, a rear surface cover 13 is bolted. Thus the whole frame body 11 is formed into a thin box-like configuration.

The aforementioned frame body 11 is formed of a metal sheet such as aluminum or the like which is U-shaped in cross section to be reinforced in the strength. The metal sheets are connected to each other with a bolt to be formed as a frame having a configuration of front view of a drawer. The display panel 12 is formed of a metal sheet such as aluminum or the like which has a rectangular configuration corresponding to the frame body. In addition, the rear surface cover 13 is constituted of three metal sheets 13*a* through 13*c*, each of which is fixed to the frame body 11. Then, this sign device is erected on one end portion of the road with the pillar 14.

Figure 3:
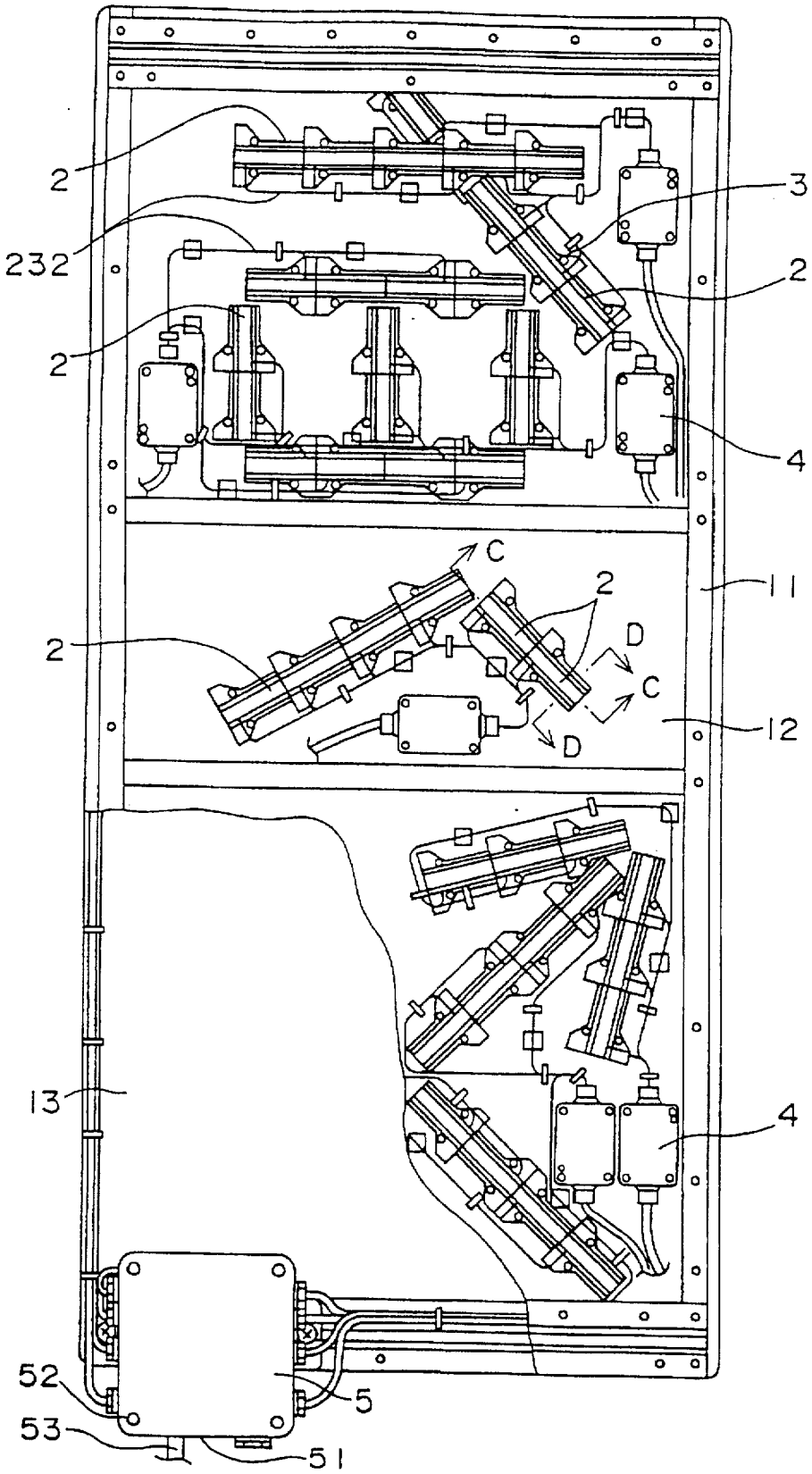
FIG. 3 is a rear view in which part of FIG. 1 is broken.

On the aforementioned display panel 12, display grooves 12*a* are formed which penetrate the display panel in the direction of the thickness of the display panel. These display grooves 12*a* constitute a pattern formed by overlapping the Chinese character representing the "right", the Chinese character representing the "left" and a hiragana letter representing the direction "to" on the upper half thereof. Further, on the lower half thereof, a right upward directed arrow pattern and a left upward directed arrow pattern are formed. Then, as shown in FIG. 3 illustrating a rear surface structure in which part of the rear surface cover 13 is removed, a plurality of display element units 2 are arranged along the aforementioned each of the display grooves 12*a* to be attached on the display panel 12 with a screw 3. These display element units 2 have LED's as a light source as described hereinbelow. A cord 232 pulled out of each of the units 2 extends along the rear surface of the display panel 2. The cord 232 is appropriately connected at a terminal 4 followed by being electrically connected to a circuit part 5 attached on the aforementioned frame body 11.

The circuit part 5 includes a circuit box 51 having a thin box-like shape and is fixed to the lower part of the aforementioned frame body 11 with a bolt 52 or the like. Inside of the aforementioned circuit box 51 a control circuit not shown is installed which selectively lights or flickers the aforementioned display element unit 2. Incidentally, the control circuit comprises various switching circuits which are commonly used. Thus detailed explanation of which is omitted here. In addition, from this circuit part 5 a cord 53 provided with a connector is pulled out for electrical connection to a battery box 6 supported by a lower portion of the aforementioned pillar 14. In the battery box 6, a dry battery is accommodated as a power source.

Figure 4:
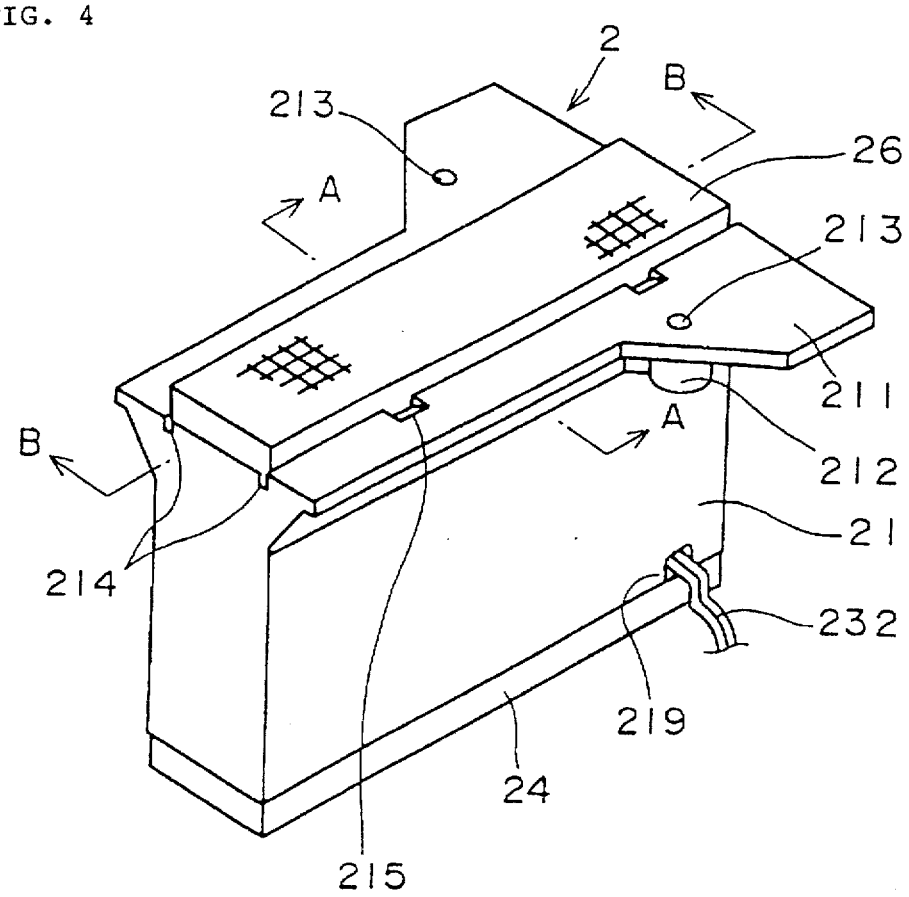
FIG. 4 is a perspective view of a display element unit.
Figure 5:
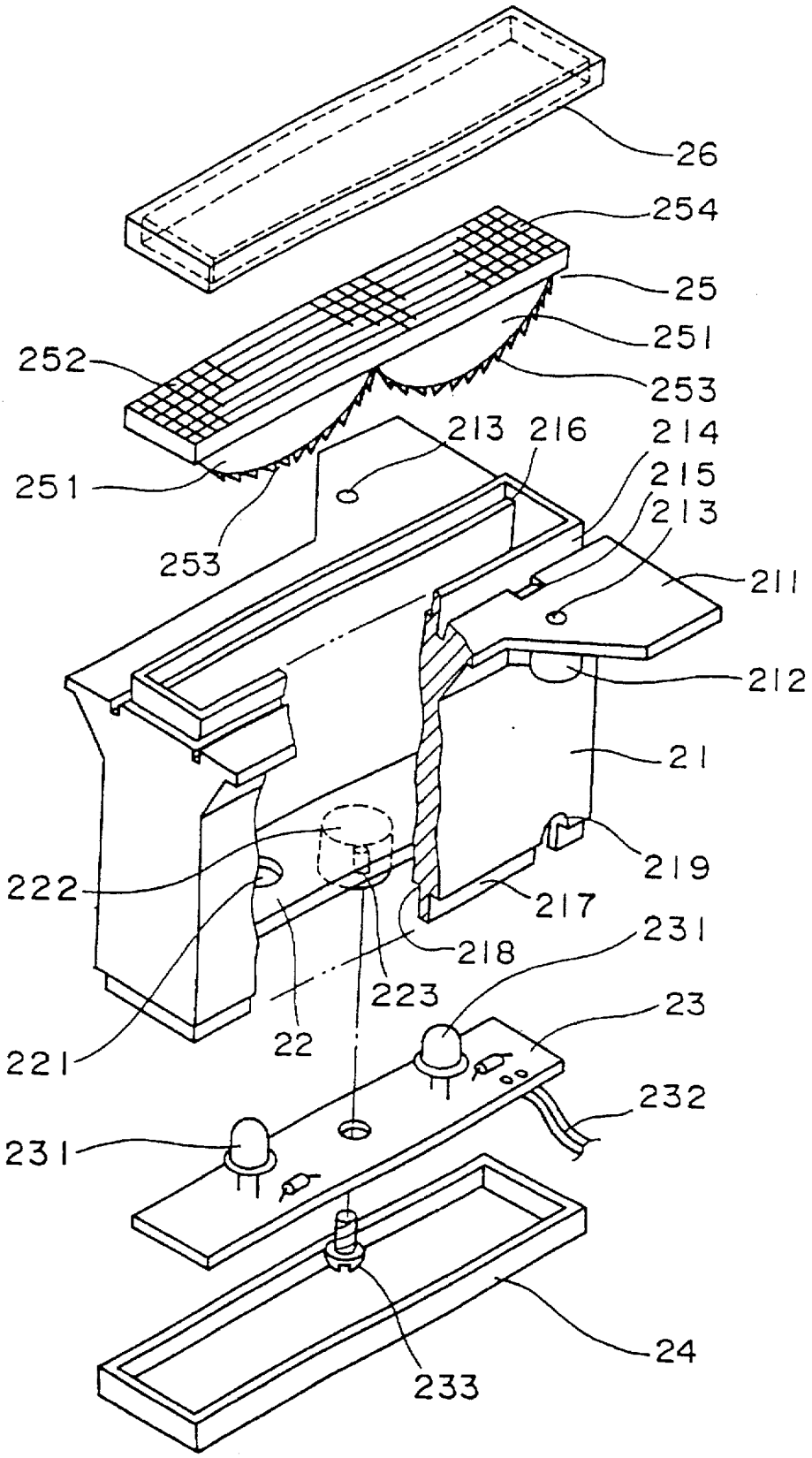
FIG. 5 is a partially exploded perspective view of the display element unit.
Figure 6:
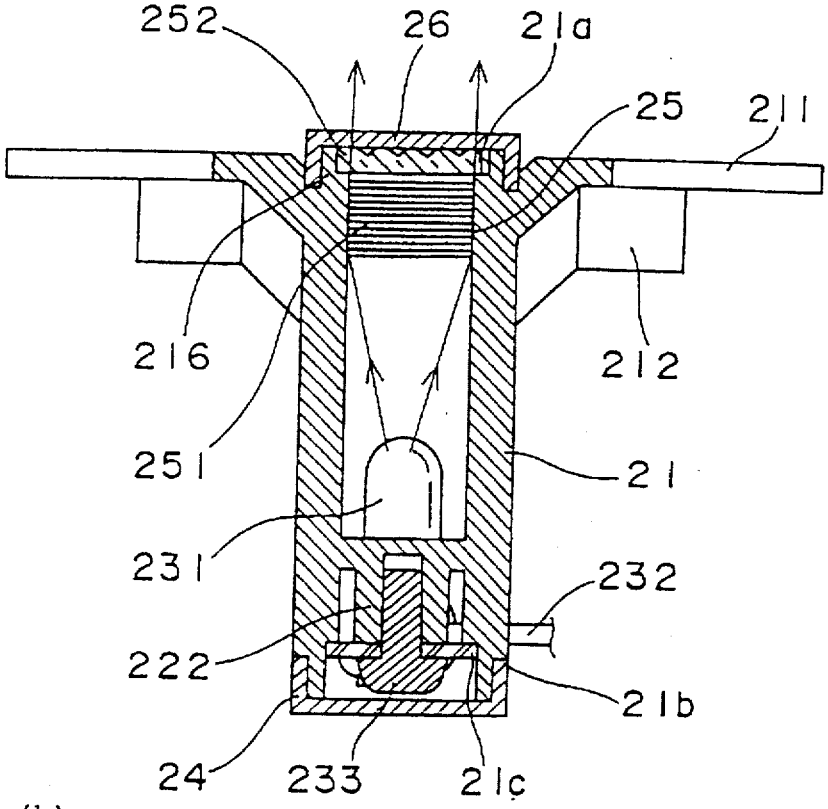
FIGS. 6A and 6B are an expanded sectional view taken along line A—A and line B—B, respectively, of FIG. 4.
Figure 6:
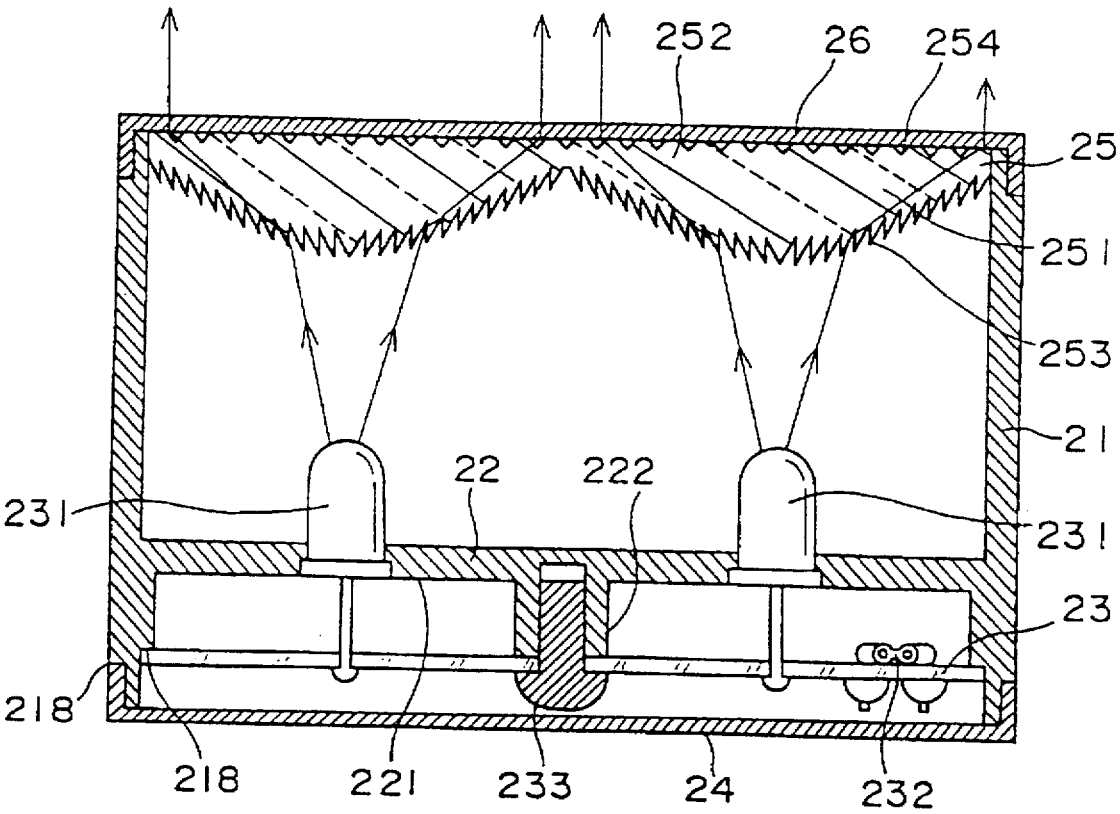

FIG. 4 is an external view showing an example of the aforementioned display element unit. FIG. 5 is a partially exploded perspective view of the example. FIGS. 6A and 6B are expanded sectional views taken along lines A—A and B—B of FIG. 4. The display element unit 2 is assembled in the resin-molded unit case 21 whereas the unit case 21 is formed in a width approximately equal to the aforementioned groove of the display panel as a rectangular cylinder having an elongated bottom with a predetermined length. On one end portion of the upper side shown in FIG. 4, a support flange 211 is integrally formed which has a plane surface with a wing-like configuration formed in a thin width at one end portion thereof and in a wider width on the other end thereof so as to form a tapered configuration. Then, at a position shifted to the other side of the rear surface of this support flange 211, a boss 212 is integrally formed on which a blind structure screw hole 213 is formed from the surface side of the support flange 211.

On one end portion of the aforementioned unit case 21, a recessed grooves 214 are formed along an outside of the rectangular open fringe. At the same time, as described hereinbelow, injection recessed portion 215 is formed at plurality of places of the recessed grooves 214 for injecting adhesive into the recessed groove 214 as will be described hereinafter. In addition, an inside step portion 216 is formed by engraving an inner wall along the lengthwise direction of the open fringe of the unit case 21. Further, on the other end of the lower side shown in FIG. 5 of the aforementioned unit case 21, an outer side surface and an inner side surface of the rectangular open fringe are engraved so that an outside step portion 217 and an inner step portion 218 are engraved respectively along the open fringe. Further, on part of the open fringe, a cord insertion notch 219 is formed for pulling out a cord 232. Further, two LED insertion holes 221 are penetrated through the inner bottom portion 22 of the case unit 21, and in the central portion of the inner bottom portion of the rear surface of the inner bottom portion a boss 222 is integrally formed. Then a screw hole 223 is opened on this boss 222.

Further, in the aforementioned display element unit 2, a rectangular printed circuit board 23 is provided which can be inserted into the aforementioned unit case 21. Two LED's are mounted on this printed circuit board 23 and the printed circuit board 23 is provided with a predetermined electrical connection. At the same time, a cord 232 for supplying electricity is pulled out of the printed circuit board 23. Then, the printed circuit board 23 is disposed on the rear side of the inner bottom portion 22 of the aforementioned unit case 21. The printed circuit board 23 is positioned after the fringe of the printed circuit board 23 is allowed to come into contact with the aforementioned inside step portion 218.

The LED's mounted on the printed circuit board 23 is fixed to the unit case 21 with a screw 233 threaded into a screw hole 223. Further, the aforementioned cord 232 is pulled out of the unit case 21 from the cord insertion notch 219. Then, a resin-made rear surface cap 24 having a rectangular shallow plate configuration is covered from the rear surface of the unit case 21. Thus the rear surface cap 24 is attached to the other end portion of the unit case 21 with adhesive in a state in which the cap 24 engages with the outside step portion 217 to seal the other end portion side of the unit case 21.

Further, a lens 25 is incorporated on one end portion of the aforementioned unit case 21. The lens 25 is constituted so that two curve-shaped light expanding part 251 and a plate-shaped light dispersing part 252 are integrally molded with transparent resin. The both end portions of the light dispersing part 252 are allowed to project from the light expanding part 251 so that the projecting portion is anchored to the inside step portion of the aforementioned unit case 21 and held in the case 21. The light expanding part 251 is constituted so that the two curve-shaped portions having respective optical axes which are allowed to correspond to the aforementioned two LED's 231 is directed downward, and the two curve-shaped portions are arranged in parallel to each other.

On the projecting surface of the light expanding part 251, a plurality of light expanding grooves 253 having a jagged cross section on the projecting surface and projecting in the widthwise direction are formed in the lengthwise direction of the lens. This light expanding groove 253 promotes the expanding function of light. This light expanding groove 253 is provided on the surface of the aforementioned light expanding part 251 with the result that a substantial light dispersing angle can be enlarged without enlarging the downward width of the light expanding part 251, or the downward projecting length thereof. Consequently, a space size between the LED's 231 and the light expanding part 251 can be reduced by the reduced thickness of the light expanding part 251. This reduces the size of the unit 2. On the other hand, the light dispersing part 252 is constituted so that the light dispersing groove 254 with a surface having a V-shaped cross section is formed both in the lateral and latitudinal square configuration so that light passing through the light dispersing part 252 at the V-shaped surface thereof is dispersed in the lengthwise and widthwise direction of the lens 25.

Further, a rectangular shallow plate-shaped surface cap 26 is covered on one end portion of the aforementioned unit case 21 from the upper side of the aforementioned lens 25. The fringe of the cap 26 is inserted into a recessed groove 214 of the aforementioned unit case 21 and fixed to one end portion of the unit case 1 with adhesive filled in the recessed groove 214. The surface cap 26 is formed of molded transparent resin, and is formed in the same standard with the aforementioned rear cap 24. Consequently, when the display element unit 2 is actually constituted, common parts can be used for the caps 24 and 26 at the front and rear surfaces respectively. This can reduce the number of parts which constitute the display element unit 2. Further, the adhesive is filled from the injection recessed portion 215 into the recessed groove 214.

Additionally, the fringe of the surface cap 26 is inserted into the recessed groove 214 before the fringe of which is bonded to the recessed groove 214 of the unit case 21. At that time, since the surplus adhesive is stored in the injection recessed portion 215, the adhesive does not come out of the surface of the surface cap 26. The surface side of the unit case 21 is sealed with this surface cap 26 to provide a water-proof protection. Further, the surface cap 26 is constituted in such a manner that the surface height of the cap 26 is projected from the aforementioned support flange 211.

Therefore, when electricity is supplied to the display element unit 2 via the cord 232, the two LED's are lit or flickered at the same time. Otherwise, the two LED's emit either red or amber-colored light. This emitted light reaches the lens 25 at a predetermined light emitting angle along an optical axis of the LED's 231 as shown in FIGS. 6A and 6B. Light can be expanded to an area corresponding to approximately half of the lengthwise direction of the lens 25 by forming the light expanding part 251 of the lens 25 in a curved shape with a light expanding groove 253 on the surface thereof. Incidentally, since the widthwise direction of the lens 25 has a small size, the front width of the lens 25 is included in the light emitting angle of the LED's 231. Thus, it is not necessary to constitute the light expanding part 251 so as to expand light in this direction.

Consequently, each light emitting from the two LED's 231 is expanded so that each bundle of light is expanded to an area corresponding to an approximately half of the lengthwise direction of the lens 25. Then, the expanded light is dispersed both in the lengthwise and in the widthwise direction with a light dispersing groove 254 in the light dispersing part 252, an approximately uniform light projects from the entire surface of the lens 25.

Consequently, in this display element unit 2, uniform light can be emitted from the entire surface of the lens 25, namely the entire surface of the surface cap 26 only by using the two LED's as a light source. For example, assuming that the surface cap 26 has a length of 6 cm and a width of 1 cm, the rectangular area can be constituted as a display unit that can uniformly illuminate this rectangular area. Consequently, an area of 6 $cm^2$ can be uniformly illuminated by using two LED's having a diameter of about 5 mm. This means that an area about thirty times can be illuminated. On the other hand, from another viewpoint, it is possible to constitute the light source as a linear light source having a thickness of about 1 cm and a length of about 6 cm.

Figure 7:
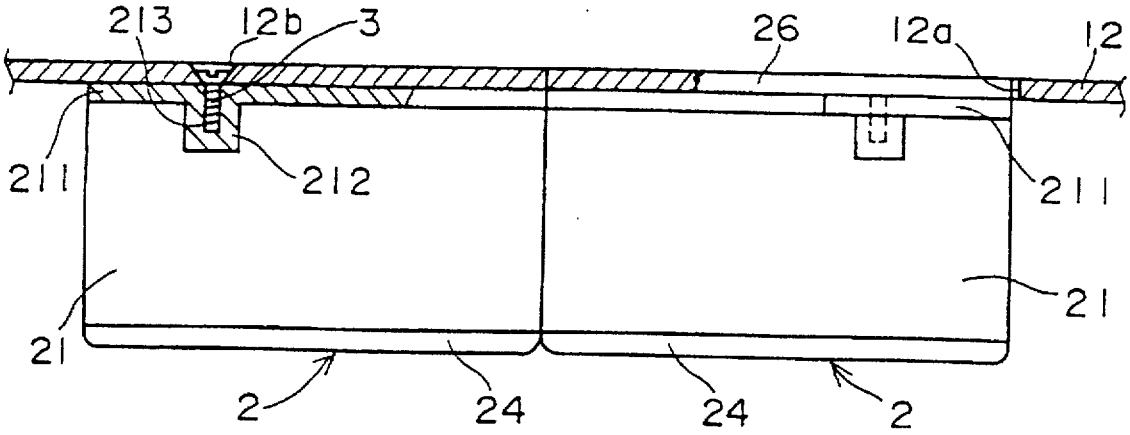
FIGS. 7A and 7B are an expanded sectional view taken along line C—C and line D—D, respectively, of FIG. 3.
Figure 7:
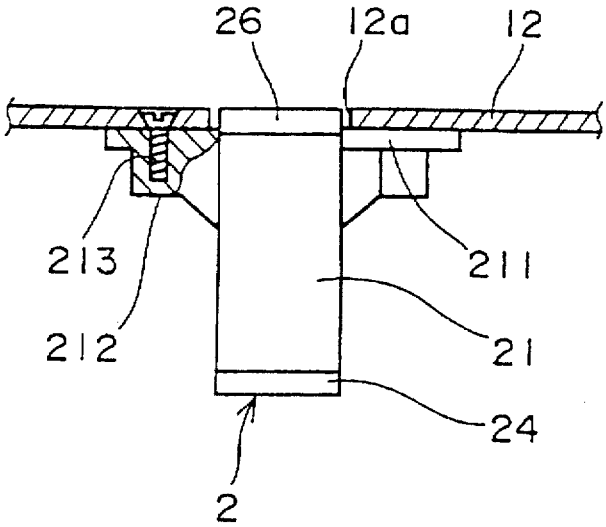

This display unit can be attached on a display panel 12 by inserting the surface cap 26 into a display groove 12*a* provided on the display panel 12 with the support flange 211 integrally provided on the unit case 21 contacting the rear surface of the aforementioned display panel 12 followed by threading a screw 3 into a screw hole 213 from the surface side of the display panel 12 by means of an insertion hole **12*b* provided at a place corresponding to the display panel 12 as shown in FIGS. 7A and 7B illustrating expanded sectional views taken along lines C—C and D—D of FIG. 3. At this time, a tape having an adhesive surface on both sides thereof can be used to attach the display element unit on the display panel 12. In this case, since the other end of the support flange 211 is widely formed in a tapered configuration, the display element unit can be stably attached on the display panel by enlarging a large contact area where the support flange 211 comes into contact with the surface panel 12**.

The display element unit 2 can be positioned in the widthwise direction with respect to the display groove **12*a* by attaching the aforementioned display element unit 2 in the aforementioned display groove 12*a* opening in the display panel 12*a*. Further, since each of the aforementioned display grooves 12*a* is formed in the length equal to the cardinal number of times of the length of the display element unit 2, as shown in FIG. 1, the display element units are arranged in series in each of the display groove 12*a* in the number corresponding to the aforementioned cardinal number of times. For example, in this embodiment, a pattern designating a Japanese hiragana letter representing the direction "to" in English comprises a display groove in which two display element units 2 are arranged in series, and a display groove 12*a* in which four display element units are arranged in series. Consequently, the unit case 21 in each of the display element units 2 is allowed to come into contact with each other at the sides thereof thereby positioning the unit case 21** in the lengthwise direction.

Further, at this time, a plurality of display element units 2 are arranged at rear surface of the display panel 12 along the display groove **12*a* in a packed state. The width of the support flange 211 is reduced in size as much as possible at one side portion thereof whereas the width of the support flange 211 is formed in a tapered configuration at a wide portion thereof. This reduces mutual interference of the support flange 211 of adjacent display element units 2. This can facilitate the design of the display groove of the display pattern. In particular, as shown in FIG. 3, the effect of avoiding the mutual interference resulting from the configuration of the support flange 211 is high at a portion which the display groove 12*a*** diagonally intersects.

Incidentally, in this embodiment, in the display element unit of the display pattern representing the Chinese character "right", "left" and a Japanese hiragana letter representing the direction "to", a unit is used which has a red-colored LED as a light source. On the other hand, in the display unit of a display pattern designated by an arrow, a unit is used which has an amber colored LED as a light source.

In addition, after a plurality of display element units are attached on the display panel 12 respectively, the cord 232 pulled out of each of the units is allowed to be placed on the rear surface of the display panel 12. Then the cord 232 is bonded to the terminal 4 for electrical connection to the aforementioned circuit part 5 by using a connector or the like as described above.

Figure 8:
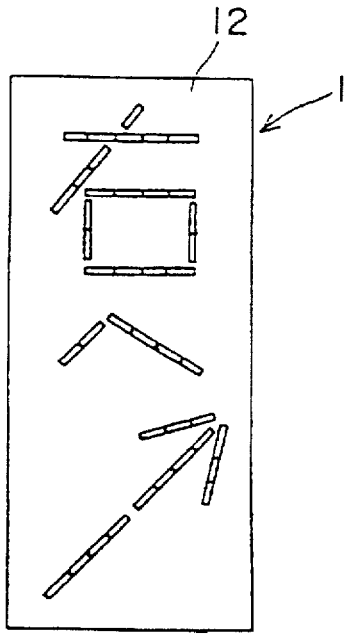
FIGS. 8A and 8B are front views showing states in which the display pattern is changed.
Figure 8:
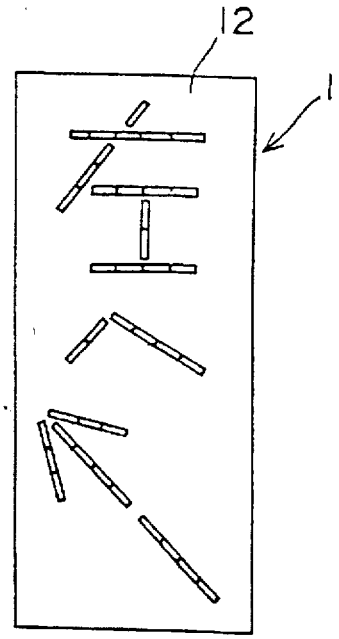

Consequently, in this sign device 1, a display element unit is selected which supplies electric power of a battery in the circuit part 5. Then a display pattern representing a direction "to the right" or a display pattern of the rightward arrow can be either lit or flickered as shown in FIG. 8A by lighting or flickering the selected display element unit whereby a display device can be provided to give a direction for changing a car lane toward the right direction with respect to running vehicles. Further, it is possible to provide a display for lighting or flickering a display pattern representing a direction "to the left" or a leftward direction as shown in FIG. 8B by changing the selection of the display element units.

Then, in this display device, each of the display element units 2 simply uses two LED's 231 as a light source. However, light demitting from each of the LED's 231 is expanded in the lengthwise direction with the action of the lens 25. At the same time, light is distributed both in the lengthwise and widthwise directions and is approximately uniformly illuminated over the entire surface of the lens 25. The light can function as a light source which emits light in an elongated or thick linear configuration. Consequently, when the display panel 12 is seen from the front side, light emits in a linear configuration along the aforementioned display groove **12*a* with the result that a linear-configuration display can be given along the display pattern constituted of the display groove 12*a***. This can remarkably reduce the number of LED's that are used as compared with the length size of the display pattern used for the display. This can also reduce the manufacturing cost and the consumed power as well. Consequently, a long time display can be accomplished even when a dry battery is used as a power source which is effective in the simplification of the power source facilities.

Incidentally, the aforementioned first embodiment is an example in which a display is given for changing the car lane either to the right or to the left. The embodiment can also applied to any case in which other displays are provided. In addition, it goes without saying that the display can be constituted as a device for providing a display in a fixed manner.

Figure 9:
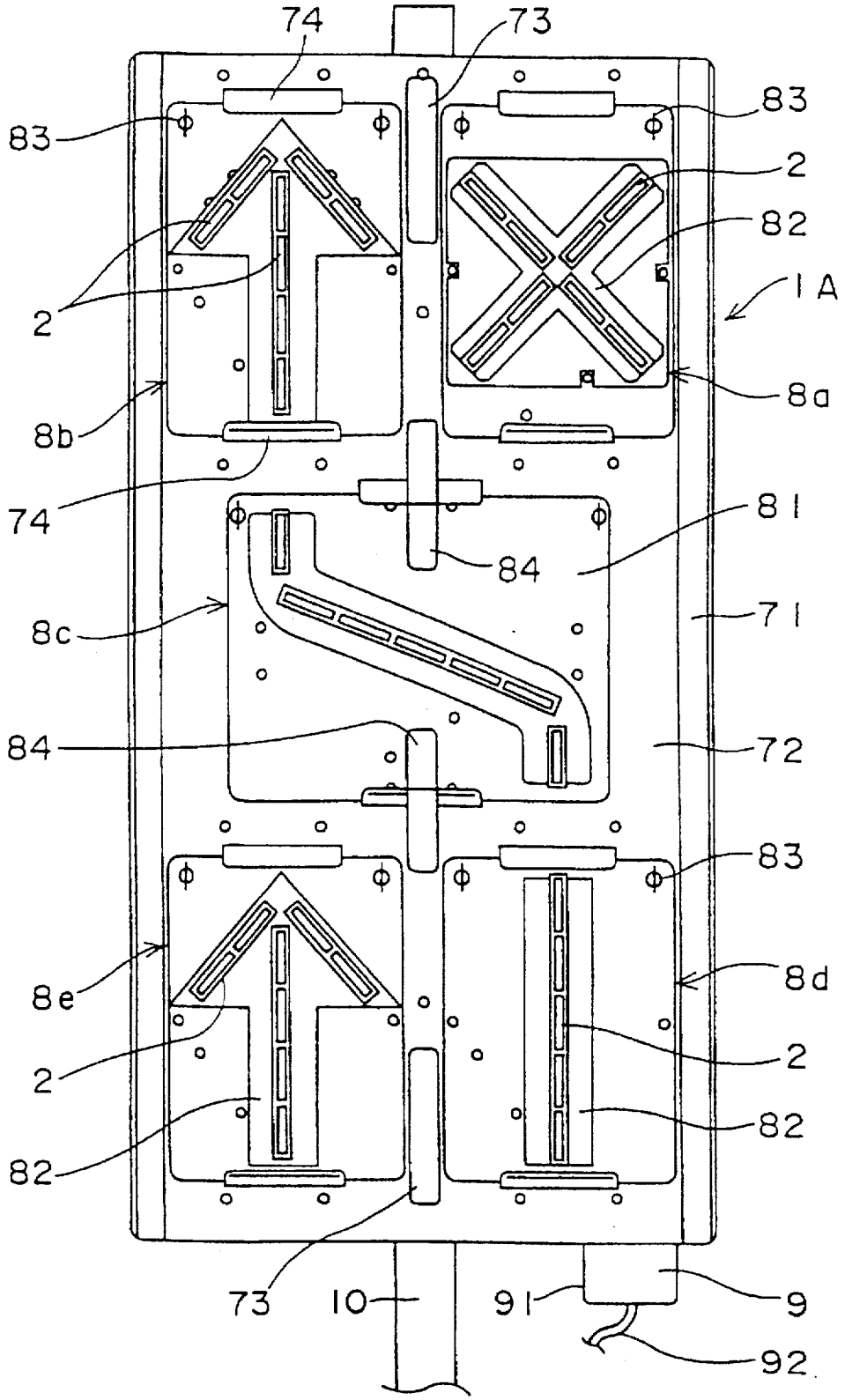
FIG. 9 is a front view of a second embodiment of the present invention.
Figure 10:
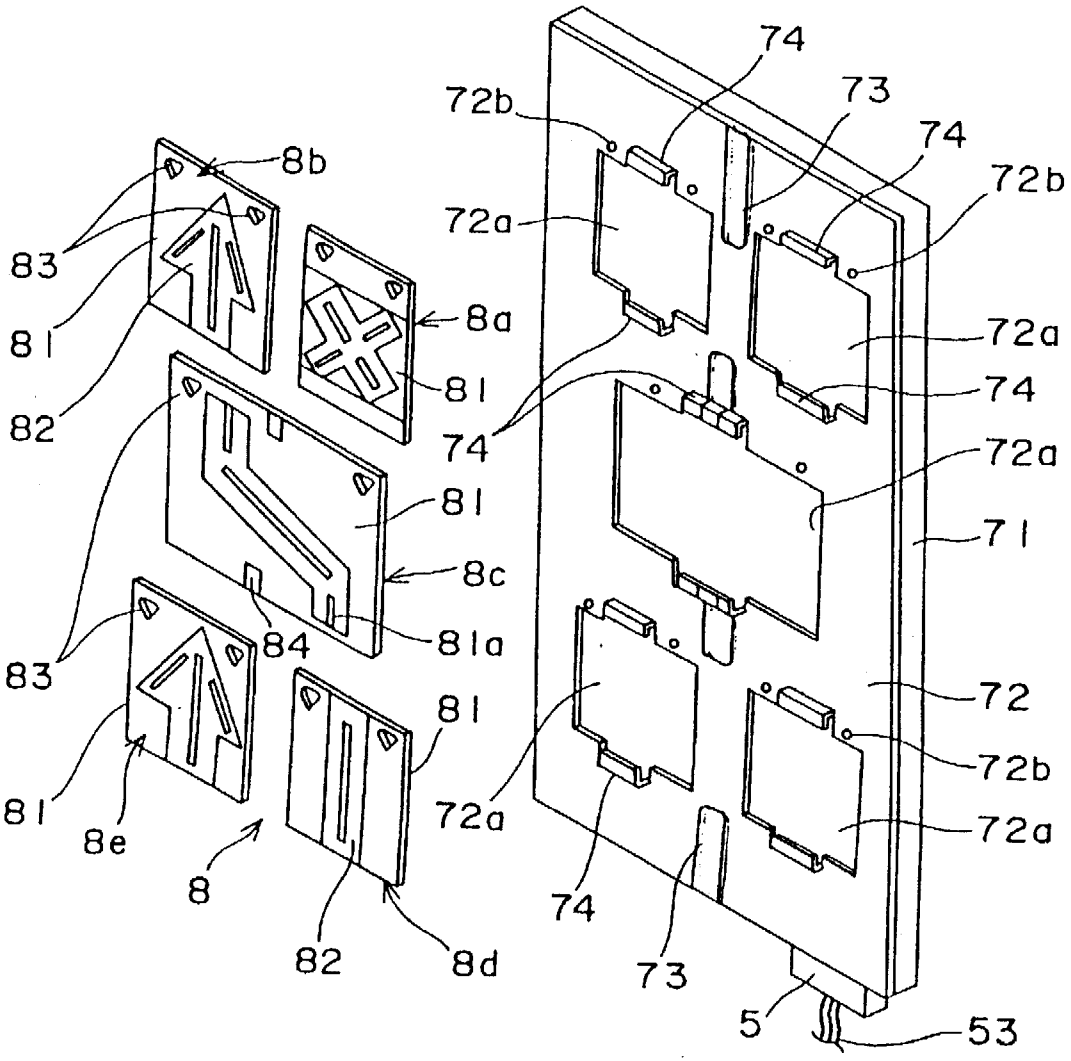
FIG. 10 is a partially exploded perspective view showing a concept construction of FIG. 9.

FIG. 9 is a front view of a second embodiment of the present invention. In the second embodiment, the present invention is applied to a traffic sign set on a road. The second embodiment is constituted as a sign for displaying a change of the car lane. As shown in FIG. 10 illustrating a partially exploded perspective view of the concept structure of the invention, this sign device 1A comprises a frame body 71 made of metal material such as aluminum or the like with a square frame-like shape which is formed into a frame-like configuration and a surface panel 72 formed of a sheet material such as aluminum or the like fixed on the surface of the frame body 71 with a bolt or the like. Then on the surface panel 72, a plurality of windows **72*a* are opened so that a display assembly 8 is detachably constituted on these windows 72*a*. Further, at a necessary portion of the area facing the aforementioned window 72*a* of the aforementioned surface panel 72 a display sheet 73 is formed which is designed after a fluorescent paint, a fluorescent tape or the like. In this example, a display sheet 73** is constituted as one for displaying a running demarcation line of roads with white color fluorescent tape.

In a state where the aforementioned display assembly 8 is attached on the surface panel 72, the cord 86 connecting to each display assembly 8 is placed on the rear surface of the surface panel 72 and electrically connects to a circuit part 9 formed in the same structure as the aforementioned embodiment by fitting the connecter 87 connected to the cord 86 into the power source. This circuit part 9 is assembled in the circuit box 91. The circuit part 9 electrically connects to the a battery box not shown via a cord 92 or the like in the same manner as the first embodiment. In addition, the sign device 1A is erected on the side portion of the road with a pillar 10.

The aforementioned display assembly 8 comprises a line or an arrow pattern indicative of a running direction of a car and an X-shaped pattern indicative of a car lane on which no car can run. Each pattern is constituted as an independent display assembly 8. These display assemblies 8 comprise two display assemblies 8*a* and 8*b* arranged on the right and the left of the surface panel 72, one display assembly 8*c* arranged on the center thereof, and two display assemblies 8*d*, 8*e* arranged on the right and the left of the lower side thereof.

Figure 11:
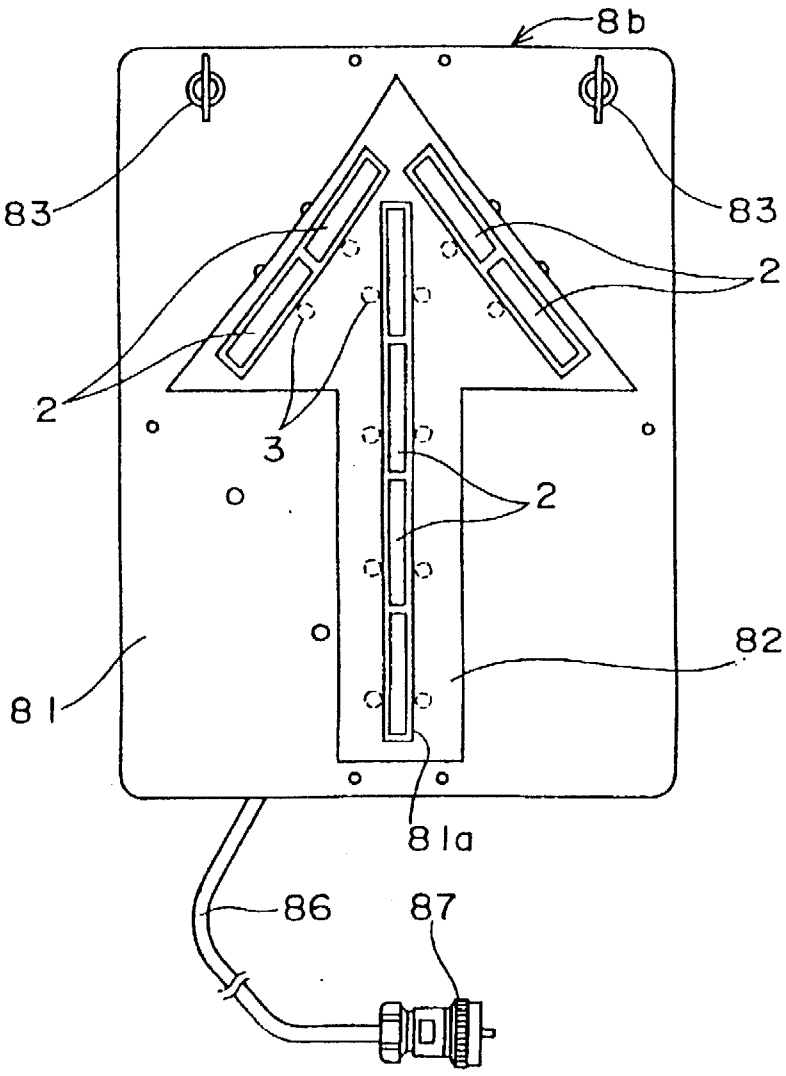
FIGS. 11A and 11B are a front view and a rear view of part of a display assembly.
Figure 11:
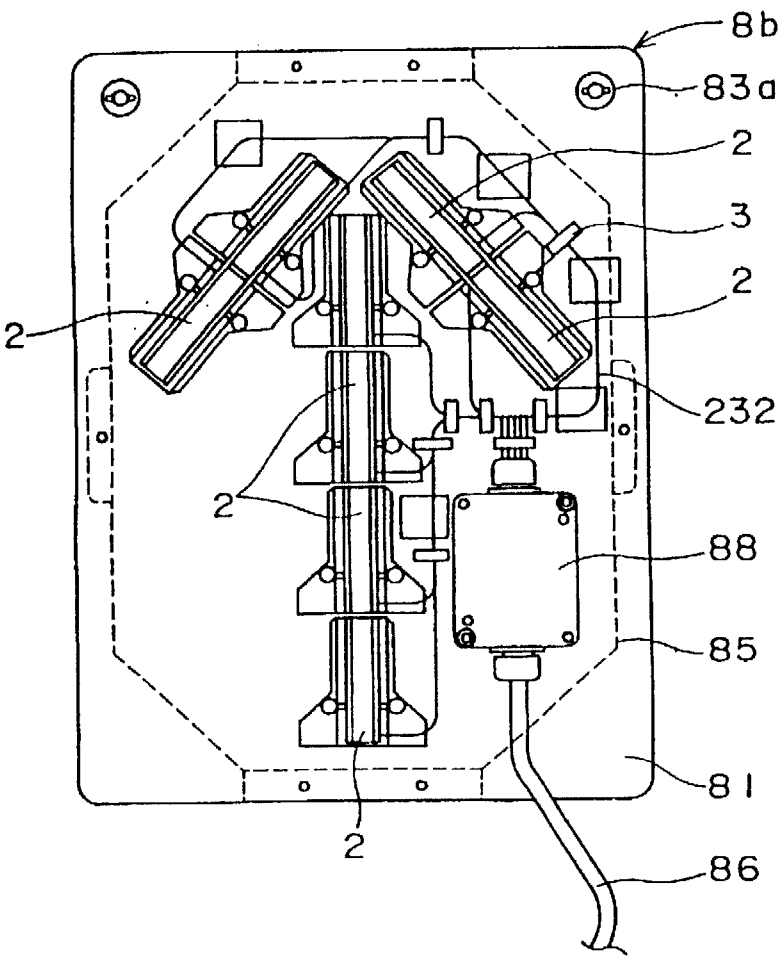

The basic structure of these display assemblies 8 are completely the same. Here, a display assembly 8*b* indicative of an arrow will be explained as a typical example. As shown in FIGS. 11A and 11B illustrating the front view and the rear view, the display assembly 8*b* comprises a panel assembly 81 formed of a metal sheet such as aluminum or the like which has a lateral and vertical size somewhat larger than the counterparts of the windows 72*a* of the aforementioned surface panel 72. On the surface of this panel assembly 81, an amber-colored fluorescent paint is applied to draw an arrow-shaped display pattern 82. Then, a display groove 81*a* which penetrates the panel assembly 81 in the direction of the thickness of the panel assembly 81 is opened in this display panel 82 so that an arrow shape is constituted as a center line of the aforementioned display pattern 82.

This display groove 81*a* has the same structure as the display groove 12*a* opened on the display panel 12 in the aforementioned first embodiment. At the same time, a plurality of display element units 2 are arranged which have the same structure as the counterpart of the aforementioned first embodiment, and is fixed to the side of the rear surface of the panel assembly 81 with a screw 3. Since this display element unit 2 will be explained in detail in the aforementioned first embodiment, the explanation thereof is omitted here.

Then, to attach this panel assembly 81 on the aforementioned surface panel 72, each of an upper and a lower anchor piece 74 are integrally provided which are formed by bending the upper and the lower fringes of each window 72*a* of the surface panel 72 into an L-shaped or a reverse L-shaped configuration. The panel assembly 81 is mounted so that the upper and the lower fringes of the panel assembly 81 is anchored to these upper and lower engaging pieces 74. At two places on the right and the left of the upper fringes of the panel assembly 81, a rotating plug 83 is arranged so that the panel assembly 81 is fixed to the surface panel 72 by engaging the panel assembly 81 into a plug hole 72*b* provided on the right and left of the upper portion of each window 72*a* of the surface panel 72. This rotating plug 83 is already widely known. The engaging portion 83*a* provided on the end portion projecting toward the rear surface of the panel assembly 81 is inserted into the plug hole 72 on the surface panel 72 so that the panel assembly 81 can be attached on the surface panel 72 in a sealed manner on the surface panel 72 or the panel assembly can be detached therefrom in one-time operation.

Incidentally, as shown in FIG. 9, in the central display assembly 8*c* out of the aforementioned display assembly 8, a running demarcation line 84 which continues to the running demarcation line 73 formed on the surface panel 72 is drawn in white paint.

In addition, the arrow pattern designated by the aforementioned display panel 8*b*, 8*c* is provided with a display element unit which uses an amber colored LED whereas X-shaped pattern designated by the display assembly 8*a* is provided with a display element unit which uses a red colored LED.

In addition, on the rear surface of the panel assembly 81 in the display assembly 8, the rear surface cover 85 is attached with a rivet, a screw or the like to seal the aforementioned display unit 2 as shown by a broken line in FIG. 11B. In addition, from part of the rear surface cover 85, a cord 86 is pulled out to connect the connector 87 to the end of this cord 86. Reference numeral 88 designates a terminal to which the cord 232 is connected which is pulled out from each of the display element units 2.

In the second embodiment, electric power is supplied to the display element units 2 in each display unit 8 from the power source not shown with the result that two LED's incorporated in each of the display element units 2 are lit respectively. As described above, in each of the display units 2 the lit LED's illuminate approximately the entire area of the surface cap with the action of the lens. This allows each of the display units 8 to emit linear light along the display groove 81*a* for displaying the display pattern constituted of the display groove 8*a*. Thus, in the whole sign device 1A, an sign is displayed to change the car lane to the right by lighting all the five display assemblies 8.

Figure 12:
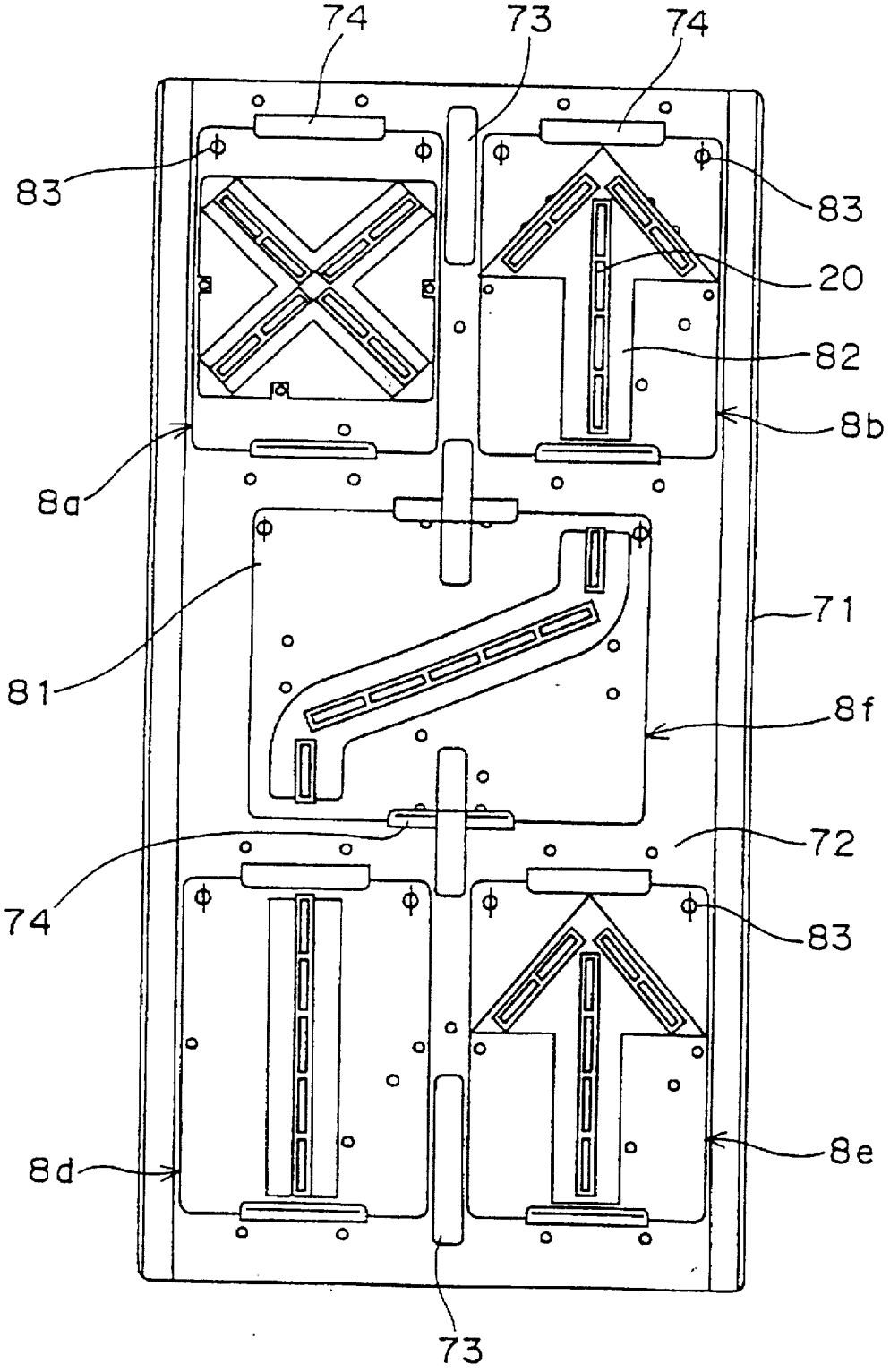
FIG. 12 is a front view is a f showing a state in which a display pattern of a second embodiment is changed.

On the other hand, in case where it is desired to change the display of the sign, for example, as shown in FIG. 12, when it is desired to display an sign to change the car lane to the left, the display assembly 8*c* is replaced with the display assembly 8f shown in FIG. 12 whereas the positions of the display assemblies 8*a* and 8*b* are changed with each other, and the positions of the display assemblies 8*d* and 8*e* are changed with each other. The display assembly 8*f* has the same structure as the display assembly 8*c* except that the display pattern of the display assembly 8*f* is symmetrically formed on the right and the left side. In this case, each of the display assemblies 8 can be detached from the surface panel 72 by removing the fitting of the connector 87 connected to the cord 86 of each of the display assembly 8 from the power source followed by operating the rotating plug 83 and further removing the panel assembly 81 from between the upper and the lower engaging pieces 74.

Then, after a correct display assembly 8 is positioned into predetermined windows 72*a* of the surface panel 72, each of the display assemblies 8 are attached on the display panel 72 in the reverse order. Then the connecter 87 connecting to each of the cord 86 is fit into the power source thereby completing the change of the display pattern. As a consequence, this time the sign device serves as a display unit to change the car lane to the left.

In the second embodiment of the display unit, the plurality of display element units 2 used for the display by emitting the display pattern 82 in each of the display assemblies 8 in a linear configuration are constituted so that two LED's are used as a light source as explained in the first embodiment. For all that, it is possible to use the LED's as an elongated rectangular or a linear light source by dispersing light emitted from each of the LED's in the widthwise and the lengthwise directions with the action of the lens and providing an approximately uniform illumination over the entire area of the surface of the lens. This can remarkably reduce the number of LED's that are used as the light source as compared with the length of the display pattern. This can also reduce the cost of the display unit and the consumed power. At the same time the display can be provided for a long time even when a dry battery is used as a power source as described above.

Furthermore, in the second embodiment, the display pattern 82 is formed of fluorescent paint or a fluorescent tape. Then, the display groove 81*a* is opened approximately in the center of this display pattern 82 so that the entire area of the display pattern 82 can be used for the display by using the reflection of the illumination light at the surface of the display pattern 82 from the display element unit 2. As a consequence, the display can be provided by illuminating the whole display element unit including the surface of the display pattern 82 as well as the lens surface of the display element unit 2. Thus, it becomes possible to further heighten the expansion effect of the display area by means of a small number of LED's.

Further, in the second embodiment, the sign device 1A as a whole can constitute a predetermined display pattern and can designate the display pattern by replacing the display assemblies 8. Consequently, there is no display element units, namely LED's that are useless in the display of such display patterns. Further, the number of LED's in the second embodiment can be reduced as compared with the first embodiment. Further, in the replacement of the display assemblies, each of the display assemblies 8 can be independently detached from the display panel 72 with the result that the replacement of the display assemblies 8 can be performed extremely easily.

Incidentally, in the second embodiment, an example is shown in which an sign is displayed to change the car lane either to the right or to the left. However, the concept of the present invention can be applied to a case in which other signs are displayed. In particular, it is possible to display various kinds of signs by changing the combination of various display assemblies when the various display assemblies are prepared.

Further, both the first and the second embodiments are examples in which the present invention is applied to traffic signs installed on a road surface. However, it is also possible to widely use the present invention for advertisement displays or other purpose displays.

As explained above, since the display device of the present invention has LED's disposed in an elongated open unit case as a plurality of light sources arranged along a display pattern, and uses a display element unit having a lens for dispersing light emitted from the LED's at least in the lengthwise direction of the aforementioned unit case. Thus the present invention has an advantage in that light can be emitted from a relatively large area with a small number of LED's by using the display element unit, and a display pattern can be displayed which has a relatively large area compared with the number of LED's so that the cost of the display can be reduced and the consumed power thereof can be also reduced.

Further, in the case where the display is constituted in such a manner that light sources are arranged along a common display pattern to change the display pattern so that the light sources are selectively lit, the whole number of LED's can be reduced by using the display pattern and the cost and the consumed power can be reduced.

In addition, a display pattern is formed on a panel assembly provided separately from the display pattern of the display, and the panel assembly can be detached from the display with the result that the display pattern can be replaced and various display pattern can be changed. At the same time, a display can be realized that can change the display with a small number of LED's in this case.

Further, in the display element unit of the present invention, a rectangular cylinder part formed in a rectangular cylindrical configuration with an elongated opening and a support flange provided on one end portion of the rectangular cylinder part constitute a unit case, one or more LED's are mounted on a printed circuit board incorporated and supported in the other end portion of the unit case, and a lens for dispersing light emitted by the LED's either in the lengthwise direction or in the widthwise direction of the unit case is incorporated in the one end portion of the unit case. Consequently, the lens can disperse the light emitted by the LED's in the lengthwise and the widthwise directions so that a wide area can be illuminated with one LED. Thus, a display can be realized that can display a display pattern with a relatively large area with a small number of LED's.

Further, one side portion of the support flange provided on the unit case is formed in an narrow width whereas the other side portion thereof is formed in a tapered wide width. Consequently, a plurality of display element units can be arranged on the display panel with no interference between adjacent display element units.

What is claimed is:

1. A display device in which a plurality of display element units are arranged along a display pattern for displaying said display pattern by emitting light from said plurality of display element units, each of said plurality of display element units comprising:

an elongated unit case;

at least one light emitting diode (LED) provided in said unit case; and an elongated lens provided in said unit case which disperses light at least in a lengthwise direction of said unit case; and wherein:

a linear display groove is opened along a desired display pattern and the plurality of display element units are arranged along said linear display groove and attached on a display panel; and said display panel is provided separately and detachably from said plurality of display element units such that each of said plurality of said display element units is detachable from said display panel, and whereby said desired display pattern having a large display area can be provided using a small number of LED's.

* * * * *